US007884565B2

(12) United States Patent
Kern et al.

(10) Patent No.: US 7,884,565 B2
(45) Date of Patent: Feb. 8, 2011

(54) HUMAN-MACHINE INTERFACE WITH PASSIVE SOFT STOPS

(75) Inventors: James I Kern, Chandler, AZ (US); James Casey Hanlon, Queen Creek, AZ (US); Justin A. Tanner, Queen Creek, AZ (US)

(73) Assignee: Honeywell International Inc., Morristown, NJ (US)

( * ) Notice: Subject to any disclaimer, the term of this patent is extended or adjusted under 35 U.S.C. 154(b) by 540 days.

(21) Appl. No.: 11/972,224

(22) Filed: Jan. 10, 2008

(65) Prior Publication Data

US 2009/0178502 A1 Jul. 16, 2009

(51) Int. Cl.
*G05G 9/047* (2006.01)

(52) U.S. Cl. ..... 318/566; 318/626; 74/471 XY

(58) Field of Classification Search ..... 318/566, 318/574, 575, 578, 590, 626; 74/471 XY
See application file for complete search history.

(56) References Cited

U.S. PATENT DOCUMENTS 4,058,126 A * 11/1977 Leveen ..... 606/159
4,117,292 A * 9/1978 Hayes et al. ..... 200/517
4,145,590 A * 3/1979 Repplinger ..... 200/330
7,744,062 B2 * 6/2010 Dalluge ..... 251/284
2004/0010354 A1 1/2004 Nicholas et al.
2007/0164168 A1 7/2007 Hirvonen et al.

* cited by examiner

*Primary Examiner*—Bentsu Ro
(74) *Attorney, Agent, or Firm*—Ingrassia Fisher & Lorenz, P.C.

(57) ABSTRACT

A human-machine interface assembly includes a user interface and a passive force feedback mechanism. The user interface is configured, upon receipt of an input force that exceeds a null breakout force, to move from a null position to a first control position and, upon receipt of an input force that exceeds a soft stop force, to move beyond the first control position. The passive force feedback mechanism is coupled to the user interface and is configured to supply the null breakout force to the user interface when the user interface is in the null position, and supply the soft stop force to the user interface when the user interface is in the first control position. The soft stop force exceeds the null breakout force and is not supplied to the user interface unless the user interface is in the first control position.

19 Claims, 3 Drawing Sheets

HUMAN-MACHINE INTERFACE WITH PASSIVE SOFT STOPS

TECHNICAL FIELD

The present invention generally relates to human-machine interfaces and, more particularly, to human-machine interfaces that include passive soft stops.

BACKGROUND

Human-machine interfaces that are used to translate human movements to machine movements are used in myriad industries. For example, some aircraft flight control systems include a human-machine interface in the form of one or more hand or foot user interfaces. The user interfaces, or inceptors, are typically configured to be disposed in a null position and the flight control system, in response to input forces supplied to the user interface from the pilot that move the user interface from its null position, controls the movements of various aircraft flight control surfaces. No matter the particular end-use system, the human-machine interface preferably includes some type of haptic feedback mechanism back through the interface to the interface operator. These haptic feedback mechanisms may be implemented using active devices, passive devices, or both.

Haptic feedback mechanisms may, among other functions, supply a force that urges the user interface, when moved from the null position, back toward the null position. Haptic feedback mechanisms also typically supply various tactile cues to the user. For example, many haptic feedback mechanisms implement one or more "soft stops" at one or more user interface positions relative to the null position. More specifically, when the user interface is moved from the null position to a soft stop position, the haptic feedback mechanism may supply an increased feedback force to the user interface. As a result, the user may need to supply an increased amount of force to the user interface to further move the user interface beyond the soft stop position. Moreover, in some implementations it may be desired to supply different force magnitudes to the user interface depending on the direction in which the user interface is being moved. For example, it may be desirable to supply a greater force magnitude when the user interface is being moved in one direction than when it is being moved in another direction. In the context of the above-mentioned aircraft user interfaces, it may be desirable to supply a greater force magnitude when the user interface (or inceptor) is being moved in an inboard direction than when it is being moved in an outboard direction.

Presently, the above-mentioned haptic feedback functions, namely soft stops and differing force feedback magnitudes for differing directions of motion, have been implemented using active devices. More specifically, by actively controlling a motor coupled to the user interface. It is becoming increasingly desirable, however, to implement various user interfaces, such as pilot inceptors, with passive haptic feedback mechanisms. Yet, there are presently no known passive feedback mechanisms that readily implement soft stops and differing force feedback mechanisms for differing directions of motion.

Hence, there is a need for a user interface passive haptic feedback mechanism that implements soft stops and differing force feedback mechanisms for differing directions of motion. The present invention addresses at least this need.

BRIEF SUMMARY

In one embodiment, and by way of example only, a human-machine interface assembly includes a user interface and a passive force feedback mechanism. The user interface is configured, upon receipt of an input force that exceeds a null breakout force, to move from a null position to a first control position and, upon receipt of an input force that exceeds a soft stop force, to move beyond the first control position. The passive force feedback mechanism is coupled to the user interface and is configured to supply the null breakout force to the user interface when the user interface is in the null position, and supply the soft stop force to the user interface when the user interface is in the first control position. The soft stop force exceeds the null breakout force and is not supplied to the user interface unless the user interface is in the first control position.

In yet another exemplary embodiment, a human-machine interface assembly includes a user interface and a passive force feedback mechanism. The user interface is configured to move, in either a first direction or a second direction, between a null position to a control position. The user interface is further configured upon receipt of an input force having a vector component in the first direction that exceeds a first null breakout force, to move from the null position to a first control position, upon receipt of an input force having a vector component in the first direction that exceeds a first soft stop force, to move beyond the first control position, upon receipt of an input force having a vector component in the second direction that exceeds a second null breakout force, to move from the null position to a third control position in the second direction, and upon receipt of an input force having a vector component in the second direction that exceeds a second soft stop force, to move beyond the third control position in the second direction. The passive force feedback mechanism is coupled to the user interface and is configured to supply the first and second null breakout forces to the user interface when the user interface is in the null position, the first soft stop force to the user interface when the user interface is in the first control position, and the second soft stop force to the user interface when the user interface is in the third control position. The passive force feedback mechanism includes a first spring, a second spring, a third spring, and a fourth spring. The first spring is configured to supply the first null break out force to the user interface when the user interface is in the null position. The second spring is configured to supply the first soft stop force to the user interface when the user interface is in the first control position. The third spring is configured to supply the second null break out force to the user interface when the user interface is in the null position. The fourth spring is configured to supply the second soft stop force to the user interface when the user interface is in the third control position.

Furthermore, other desirable features and characteristics of the preferred human-machine interface assembly will become apparent from the subsequent detailed description and the appended claims, taken in conjunction with the accompanying drawings.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description. In this regard, although the following description is, for convenience, directed to a user interface that is configured as a control stick type of pilot inceptor, it will be appreciated that the user interface could be implemented as a pedal, yoke, lever, and the like.

Figure 1:
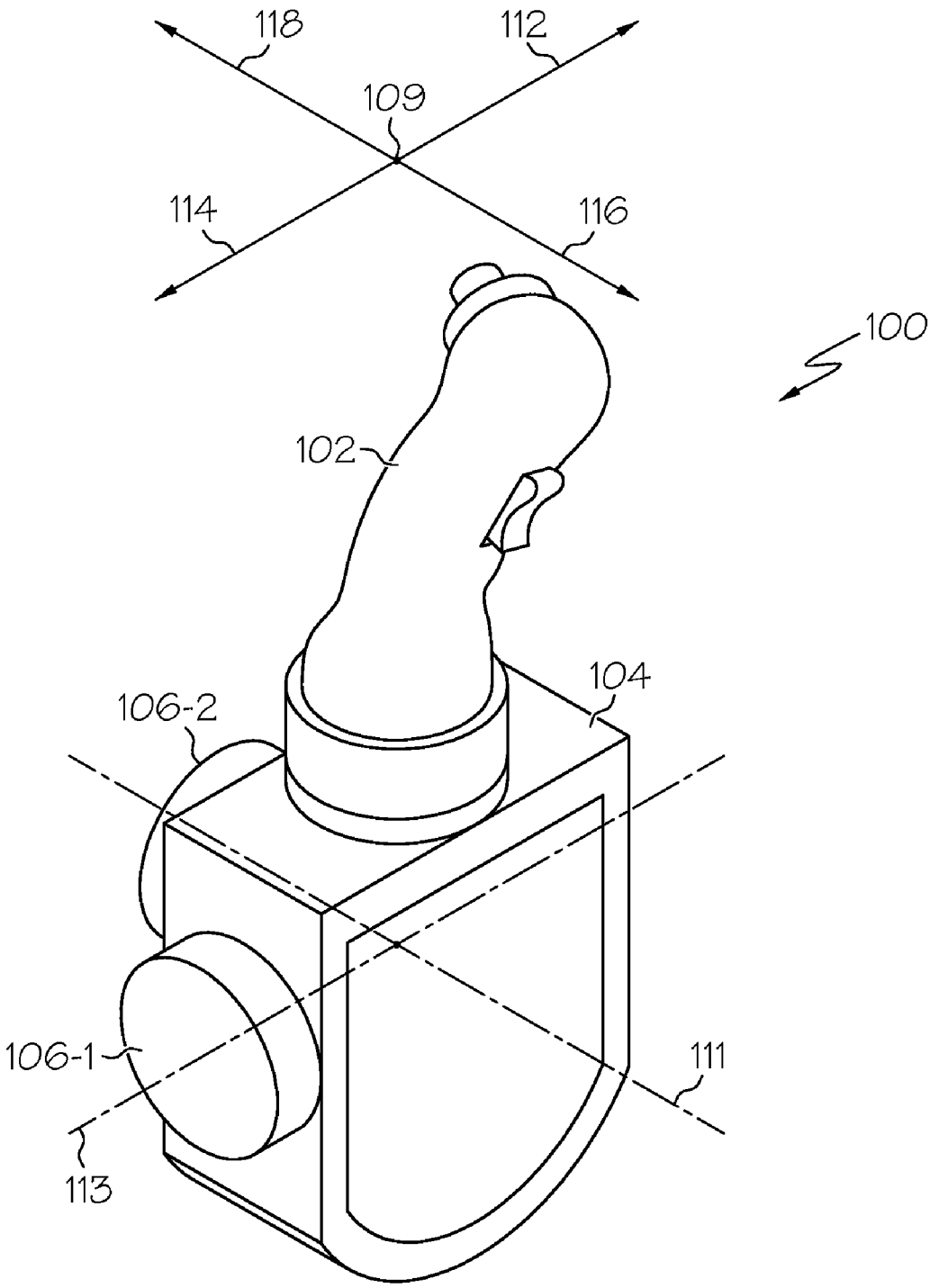
FIG. 1 depicts a simplified representation of an exemplary user interface assembly that includes passive feedback mechanisms, and with the passive feedback mechanisms depicted schematically.

A simplified representation of an exemplary embodiment of a portion of a human-machine interface assembly 100 is depicted in FIG. 1, and includes a user interface 102, a gimbal assembly 104, and a plurality of passive force feedback mechanisms 106. The user interface 102 is coupled to the gimbal assembly 104 and is configured to receive an input force from a user. The user interface 102 may be implemented according to any one of numerous configurations. In the depicted embodiment, however, it is implemented as a grip, or control stick, that is preferably dimensioned to be grasped by a hand of a user, such as a pilot (or co-pilot).

The gimbal assembly 104 is preferably mounted within a suitable, non-illustrated housing assembly, and is configured to allow the user interface 102 to be moved from a null position 109, which is the position depicted in FIG. 1, to a plurality of control positions in a plurality of directions. More specifically, the gimbal assembly 104, in response to an input force supplied to the user interface 102, allows the user interface 102 to be moved from the null position 109 to a plurality of control positions, about two perpendicular rotational axes—a first rotational axis 111 and a second rotational axis 113. It will be appreciated that if the human-machine interface assembly 100 is implemented as an aircraft flight control human-machine interface, such as a pilot (or co-pilot) inceptor, then the first and second rotational axes 111, 113 may be referred to as the roll axis and the pitch axis, respectively.

No matter the specific end use of the human-machine interface assembly 100, the gimbal assembly 104 is configured to allow the user interface 102 to be movable about the first rotational axis 111 in a port direction 112 and a starboard direction 114, and about the second axis 113 in a forward direction 116 and an aft direction 118. It will additionally be appreciated that the gimbal assembly 104 is configured to allow the user interface 102 to be simultaneously rotated about the first and second rotational axes 111, 113 to move the user interface 102 in a combined forward-port direction, a combined forward-starboard direction, a combined aft-port direction, or a combined aft-starboard direction, and back to or through the null position 109. It will be appreciated that the gimbal assembly 104 may be configured using any one of numerous gimbal assembly implementations now known or developed in the future. Furthermore, a detailed description of the gimbal assembly 104 is not needed to fully enable or describe the invention, and will thus not be provided.

Before proceeding further, it is noted that the human-machine interface assembly 100 may be implemented as either an active system or a passive system. If implemented as an active system, the human-machine interface assembly 100 may further include one or more non-illustrated motors to actively supply force feedback to the user interface 102. If implemented as a passive system, it will be appreciated that the assembly 100 would not include any motors. In either instance, however, the assembly 100 would preferably include the passive feedback mechanisms 106. In the case of the active system, the motors would be the primary means of supplying feedback force to the user interfaces 102, with the passive force feedback mechanisms 106 being the back-up feedback force source. It will nonetheless be appreciated that in the remainder of the description, the assembly 100 is described as if it were implemented as a fully passive system, without any motors.

The passive force feedback mechanisms 106, which in the depicted embodiment are depicted schematically and include a first passive force feedback mechanism 106-1 and a second passive force feedback mechanism 106-2, are mounted on the housing assembly 110 and are used to supply force feedback to the user interface 102 when the user interface 102 is moved from the null position 109. The first passive force feedback mechanism 106-1 is configured to supply force feedback to the user interface 102 in opposition to user interface displacements having a vector component in either the forward or aft direction 116, 118. The second passive force feedback mechanism 106-2 is configured to supply force feedback to the user interface 102 in opposition to user interface displacements having a vector component in either the port or starboard direction 112, 114. The passive force feedback mechanisms 106 are also configured to supply a null breakout force to the user interface 102 when the user interface is in the null position 109, and to implement soft stops at preset positions of the user interface 102. As is generally known, the null breakout force is an amount of force a user needs to supply to the user interface to move it out of the null position 109. As is also generally known, a soft stop is a "non-null position" of the user interface 102 at which a user needs to supply a stepped increase in force (referred to herein as a soft stop force) to the user interface 102 in order to move it further. It will be appreciated that the null breakout force and the soft stop force may vary. In the one exemplary embodiment, the null breakout force may be set to around one pound, and the soft stop force(s) may be set to around ten pounds.

Figure 2:
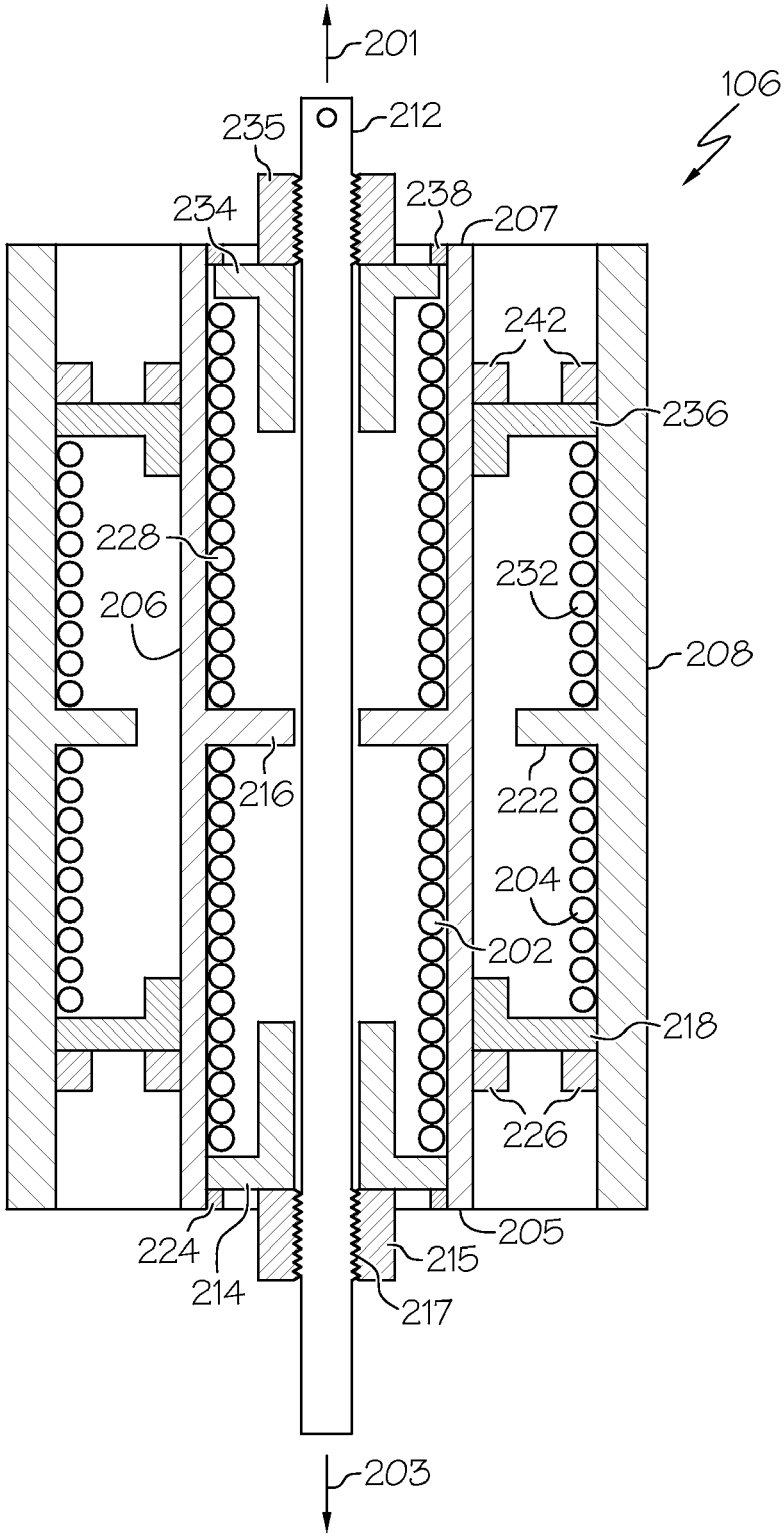
FIG. 2 depicts a cross section view of an exemplary physical implementation of one embodiment of a passive feedback mechanism that may be used with the user interface assembly of FIG. 1.

In addition to the above, the passive force feedback mechanisms 106 are also preferably configured such that the null force and the soft stop force are each adjustable. The passive force feedback mechanisms 106 are also preferably configured such that the force feedback each supplies may vary, depending on the direction in which the user interface 102 is moved. That is, the first passive force feedback mechanism 106-1 may be adjusted such that the feedback force it supplies to the user interface 102 when the user interface 102 is moved in the port direction 112 differs from the feedback force it supplies to the user interface 102 when the user interface 102 is moved in the starboard direction 114. Similarly, the second passive force feedback mechanism 106-2 may be adjusted such that the feedback force it supplies to the user interface 102 when the user interface 102 is moved in the forward direction 116 differs from the feedback force it supplies to the user interface when the user interface 102 is moved in the aft direction 118. A particular preferred embodiment of one of the passive force feedback mechanisms 106 is depicted in FIG. 2, and with reference thereto will now be described in greater detail.

The depicted passive force feedback mechanism 106 includes a first spring 202, a second spring 204, a first spring housing 206, and a second spring housing 208. The first spring 202 is disposed within the first spring housing 206 and, as will be described in more detail below, supplies the null breakout force to the user interface 102. The second spring 204 is disposed within the second spring housing 208 and, as will also be described in more detail below, is used to supply the soft stop force to the user interface 102. As FIG. 2 also depicts, the second spring housing 208 is disposed coaxial with, and surrounds, the first spring housing 206. As such, the first and second springs 202, 204 are also coaxially disposed.

As noted above, the first spring 202 supplies the null breakout force to the user interface 102. To do so, at least in the depicted embodiment, the passive force feedback mechanism 106 further includes a connection rod 212 and a first spring interface 214. The connection rod 212 extends into the first spring housing 206 and is adapted to be coupled to the user interface 102 in a manner that the connection rod 212 translates in response to movement of the user interface 102. It will be appreciated that the passive force feedback mechanism 106 may be variously disposed such that the connection rod 212 translates in the same or different movement direction as the user interface 102. For example, the passive force feedback mechanism 106 may be configured such that if the user interface 102 is moved in the port or starboard direction 112, 114 (or in the forward or aft direction 116, 118), the connection rod will concomitantly translate in the port or starboard direction 112, 114 (or in the forward or aft direction 116, 118), respectively. In other embodiments, the passive force feedback mechanism 106 may be configured such that if the user interface 102 is moved in the port or starboard direction 112, 114 (or in the forward or aft direction 116, 118), the connection rod will translate in an upward or downward direction (or vice-versa), respectively.

No matter the specific direction in which the connection rod 212 translates, its translational movement causes concomitant translational movement of the first spring interface 214. To do so, at least in the depicted embodiment, the connection rod 212 extends through the first spring interface 214 and is coupled to an adjustment nut 215 via suitable mating threads 217. The adjustment nut 215 in turn engages the first spring interface 214. It may thus be appreciated that relative rotation of the connection rod 212 and the adjustment nut 215 results in relative axial movement of these two components. The relative axial movement of the connection rod 212 and the adjustment nut 215 provides for adjustability of the null position of the connection rod 212, and to take all backlash out of the null position.

The first spring interface 214, in addition to surrounding the connection rod 212, is movably disposed within the first spring housing 206, and engages both the first spring 202 and a first end stop 224. The first end stop 224 is coupled to, and extends radially inwardly from, the first spring housing 206 via, for example, suitable mating threads, and limits movement of the first spring interfaces 214 in the direction of arrow 203 in order to retain the first spring interfaces 214 within the first spring housing 206. The first end stop 224 also provides for adjustability of the null breakout force. In particular, if the first end stop 224 is moved to increase the compression of the first spring 202 when the user interface 102 is in the null position 109, then the null breakout force will be increased. Conversely, if the first end stop 224 is moved to decrease the compression of the first spring 202 when the user interface 102 is in the null position 109, then the null breakout force will be decreased.

The first spring interface 214, as noted above, is movably disposed within the first spring housing 206 and is engaged by the connection rod 212. Thus, the first spring interface 214 will translate, relative to the first spring housing 206, with the connection rod 212. Hence, when the user interface 102 is moved out of the null position 109 and in a direction that causes the connection rod 212 to translate in the direction indicated by arrow 201 in FIG. 2, the first spring interface 214 will concomitantly translate and compress the first spring 202. The compression of the first spring 202 will result in the first spring 202 supplying a feedback force to the user interface 102 in the opposite direction (indicated by arrow 203 in FIG. 2), back toward the null position 109. The first spring interface 214 will continue to translate in the direction indicated by arrow 201 relative to the first spring housing 206, and thereby continue to compress the first spring 202, as long as movement of the user interface 102 continues to cause the connection rod 212 to translate in this same direction and until the first spring interface 214 engages a travel stop 216.

The travel stop 216, at least in the depicted embodiment, is coupled to the first spring housing 206 and extends radially inwardly therefrom. In the depicted embodiment the travel stop 216 is located approximately midway between first and second ends 205 and 207, respectively, of the first spring housing 206. It will be appreciated, however, that its relative position within the first spring housing 206 may vary depending, for example, on the length of the first spring interface 214, the amount of user interface movement desired until the first spring interface 214 engages the travel stop 216, or combinations of both. No matter its specific position, when the first spring interface 214 does indeed engage the travel stop 216, further compression of the first spring 202 ceases. However, as will be explained further below, further movement of the connection rod 212 in the direction indicated by arrow 201 may occur if the above-mentioned soft stop force is supplied to the user interface 102.

When the first spring interface 214 engages the travel stop 216, the force supplied to the connection rod 212, via the user interface 102, is reacted by the first spring housing 206, which in turn imparts an equivalent force to the second spring 204. The first spring housing 206 is movable relative to the second spring housing 208 and is adjustably coupled to a second end stop 226, which in turn engages a second spring interface 218. The second end stop 226 is adjustably coupled to and extends radially outwardly from the first spring housing 206 and radially inwardly from the second spring housing 208. The second end stop 226 may be adjustably coupled to one or both of the first and second spring housings 206, 208 using various techniques and configurations, but in the depicted embodiment these components are adjustably coupled via suitable mating threads. Thus, relative rotation of the first and/or second spring housings 206, 208 and the second end stop 226 results in relative axial movement thereof. The second spring interface 218, in addition to being engaged by the second end stop 226, is movably disposed between the first and second spring housings 206, 208 and engages the second spring 204.

The second spring 204, as was noted above, is disposed within the second spring housing 208 and supplies the soft stop force to the user interface 102. In particular, the second spring 204 surrounds the first spring housing 206 and is disposed between, and engages, the second spring interface 218 and a spring stop surface 222 that extends radially inwardly from the second spring housing 208. Because the second spring interface 218 is engaged by the second end stop 226, which is in turn adjustably coupled to the first spring housing 206, the second end stop 226 may be used to adjust the soft stop force supplied by the second spring 204. That is, if the second end stop 226 is adjusted to increase the compression of the second spring 204, then the soft stop force will be increased. Conversely, if the second end stop 226 is adjusted to reduce the compression of the second spring 204, then the soft stop force will be decreased.

As was noted above, when the first spring interface 214 engages the travel stop 216, further movement of the connection rod 212 and the first spring interface 214 relative to the first spring housing 206 ceases. However, continued movement of the connection rod 212 in the direction indicated by arrow 201 may occur if a user additionally supplies the soft stop force to the user interface 102. More specifically, if a user increases the force supplied to the user interface 102 to exceed at least the soft stop force (e.g., an additional force equivalent to the preload on the second spring 204, such that the total force supplied to the user interface 102 is at least the sum of the soft stop force and the force supplied by the first spring 202 when the first spring interface 214 is engaging the travel stop 216), then the first spring housing 206, and concomitantly the connection rod 212, will move in the direction indicated by arrow 201, and the user interface 102 will move beyond the position of the soft stop. As long as sufficient force continues to be supplied to the user interface 102 to further compress the second spring 204, user interface movement will continue until the second spring 204 is fully compressed or until some other limit, such as a mechanical hard stop, is reached.

Before proceeding further, it is noted that the first and second springs 202, 204 not only supply the null breakout force and the soft stop force, respectively, but also exhibit characteristic spring rates. The first spring 202 exhibits a first spring rate and the second spring exhibits a second spring rate. Thus, the feedback force supplied to the user interface 102 is proportional to the first spring rate when the control position of the user interface 102 is between the null position 109 and the soft stop position, and is proportional to the second spring rate when the control position of the user interface 102 is at or beyond the soft stop position. It will be appreciated that the first and second spring rates may be equal or unequal. Moreover, if the spring rates are unequal, the relative magnitudes may vary. For example, the first spring rate may exceed the second spring rate, or vice-versa. Preferably, however, if the spring rates are unequal, the first spring rate is less than the second spring rate.

Returning once again to the description, the passive force feedback mechanism 106 has thus far been described in the context of user interface movement from the null position 109 to various control positions in the direction of arrow 201, and then back to the null position 109 in the direction of arrow 203. It was previously noted, however, that the user interface 102 may be moved from the null position 109 in other directions. As such, the passive force feedback mechanism 106 is also configured to supply the null force, soft stop force, and feedback force to the user interface 102 for concomitant movements of the connection rod 212 from the null position 109 in the direction of arrow 203. To this end, the passive force feedback mechanism 106 further includes a third spring 228, a fourth spring 232, a third spring interface 234, a fourth spring interface 236, a second adjustment nut 235, a third end stop 238, and a fourth end stop 242.

It will be appreciated that the configuration of the third spring 228, the third spring interface 234, the second adjustment nut 235, and the third end stop 238 are substantially identical to the first spring 202, the first spring interface 214, the first adjustment nut 215, and the first end stop 224, respectively, and that the fourth spring 232, the fourth spring interface 236, and the fourth end stop 242 are substantially identical to the second spring 204, the second spring interface 218, and the second end stop 226, respectively. As such, a detailed description of the configuration and function of these components is not needed and will not be provided. It will nonetheless be additionally appreciated, that the null breakout force and soft stop force supplied by the third and fourth springs 228, 232, respectively, are adjustable. As such, the passive force feedback mechanism 106 may be configured to supply different null breakout forces and/or different soft stop forces for different directions of motion. Moreover, the third and fourth springs 228, 232 exhibit third and fourth spring rates, respectively. It will additionally be appreciated that the third and fourth spring rates may be equal or unequal. Furthermore, the first and third spring rates may be equal or unequal, and the second and fourth spring rates may be equal or unequal. As such, the passive force feedback mechanism 106 may additionally be configured to exhibit different force gradients for different directions of motion.

Figure 3:
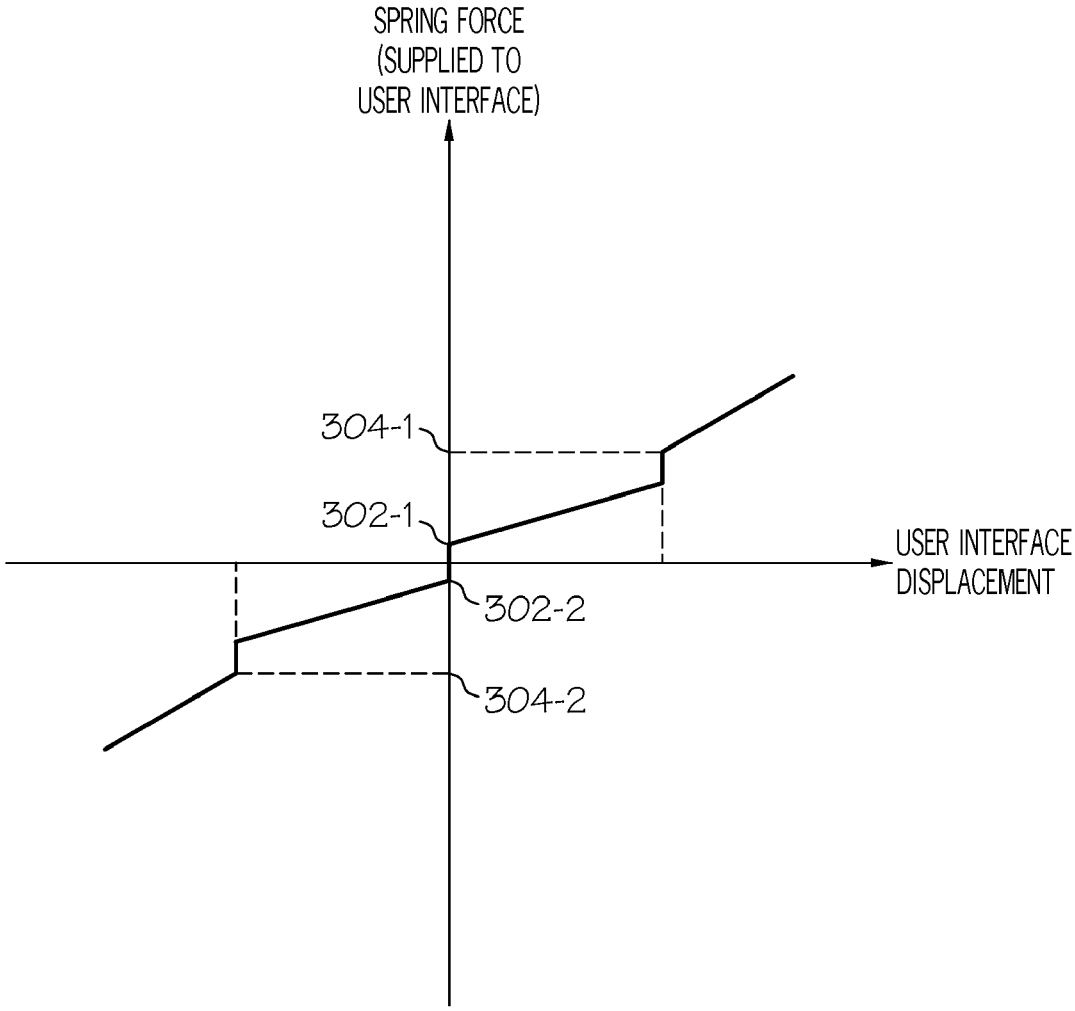
FIG. 3 depicts exemplary force versus displacement characteristic that illustrates the operation of the exemplary passive force feedback mechanism of FIG. 2.

An exemplary force versus displacement characteristic that illustrates the operation of the passive force feedback mechanism 106 described herein is, for clarity and completeness, depicted graphically in FIG. 3. In the depicted embodiment, the magnitudes of the null breakout forces 302-1, 302-2 and the soft stop forces 304-1, 304-2 for the opposing directions of motion are set to be equal.

The human-machine interface assembly 100 described herein includes a pair of passive force feedback mechanisms 106-1, 106-2 that each passively implement null breakout forces and soft stops in opposing directions. It will be appreciated that the configuration depicted in FIG. 2 is non-limiting. For example, in alternative embodiments the a plurality of cams may be coupled to the axes 111, 113 and configured to engage, and thereby deflect, the springs 202, 204, 238, 242 at predetermined positions and rates to thereby supply the null breakout forces and soft stop forces.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A human-machine interface assembly, comprising:

a user interface configured, upon receipt of an input force that exceeds a null breakout force, to move from a null position, in either a first direction or a second direction, to a first control position and, upon receipt of an input force that exceeds a soft stop force, to move beyond the first control position; and a passive force feedback mechanism coupled to the user interface and configured to supply (i) the null breakout force to the user interface when the user interface is in the null position and (ii) the soft stop force to the user interface when the user interface is in the first control position, the soft stop force exceeding the null breakout force and not supplied to the user interface unless the user interface is in the first control position, the passive force feedback mechanism comprising a first spring configured to supply the null break out force to the user interface when the user interface is in the null position, and a second spring configured to supply the soft stop force to the user interface when the user interface is in the first control position, wherein:

the user interface is further configured, upon receipt of an input force having a vector component in the first direction that exceeds the null breakout force, to move from the null position to the first control position in the first direction and, upon receipt of an input force having a vector component in the first direction that exceeds the soft stop force, to move beyond the first control position in the first direction, the user interface is further configured, upon receipt of an input force having a vector component in the second direction that exceeds a second null breakout force, to move from the null position to a third control position in the second direction and, upon receipt of an input force having a vector component in the second direction that exceeds a second soft stop force, to move beyond the third control position in the second direction, and the passive force feedback mechanism is further configured to supply (i) the second null breakout force to the user interface when the user interface is in the null position and (ii) the second soft stop force to the user interface when the user interface is in the third control position, the second soft stop force exceeding the second null breakout force.

2. The assembly of claim 1, wherein:

the passive force feedback mechanism is further configured, upon movement of the user interface from the null position, to supply a feedback force to the user interface that urges the user interface toward the null position; and the feedback force is proportional to:

(i) a first spring rate when the control position of user interface is between the null position and the first control position, and (ii) a second spring rate when the control position of the user interface is between the first control position and a second control position.

3. The assembly of claim 2, wherein the second spring rate is greater than the first spring rate.

4. The assembly of claim 3, wherein:

the first spring exhibits the first spring rate and is compressed at least when the user interface is between the null position and the first control position; and the second spring exhibits the second spring rate and is compressed at least when the user interface is between the first control position and the second control position.

5. The assembly of claim 1, wherein the passive force feedback mechanism further comprises:

a first spring housing within which the first spring is disposed; and a second spring housing, disposed coaxial with the first spring housing, within which the second spring is disposed.

6. The assembly of claim 1, wherein the passive force feedback mechanism further comprises:

a connection rod coupled to the user interface and configured to translate in response to movement of the user interface;

a first spring interface coupled to the connection rod and engaging the first spring, the first spring interface configured to translate with the connection rod, to thereby compress the first spring at least when the user interface is not in the null position;

a second spring interface engaging the second spring and configured to translate with the connection rod when the user interface is between the first control position and the second control position.

7. The assembly of claim 6, wherein the connection rod is adjustable relative to the first spring interface.

8. The assembly of claim 6, wherein the first spring interface is coupled to, and is independently movable relative to, the connection rod, whereby movement of the first spring interface relative to the connection rod adjusts the null breakout force.

9. The assembly of claim 6, wherein the passive force feedback mechanism further comprises:

a travel stop extending radially inwardly from the first spring housing, the travel stop engaged by the first spring interface when the user interface is in, and beyond, the first control position.

10. The assembly of claim 6, wherein the second spring interface is coupled to, and is independently movable relative to, the first spring housing, whereby movement of the second spring interface relative to the first spring housing adjusts the soft stop force.

11. The assembly of claim 1, wherein the passive force feedback mechanism further comprises:

a third spring configured to supply the second null break out force to the user interface when the user interface is in the null position; and a fourth spring configured to supply the second soft stop force to the user interface when the user interface is in the third control position.

12. The assembly of claim 11, wherein:

the passive force feedback mechanism is further configured, upon movement of the user interface from the null position in the second direction, to supply a feedback force to the user interface that urges the user interface toward the null position; and the feedback force is proportional to:

(i) a third spring rate when the control position of user interface is between the null position and the third control position, and (ii) a fourth spring rate when the control position of the user interface is between the third control position and a fourth control position.

13. The assembly of claim 12, wherein:

the first and third spring rates are unequal; and the second and fourth spring rates are unequal.

14. The assembly of claim 1, wherein the passive force feedback mechanism further comprises:

a first cam coupled to the user interface and engaging the first spring; and a second cam coupled to the user interface and engaging the second spring at least when the user interface is in the first control position.

15. A human-machine interface assembly, comprising:

a user interface configured to move, in either a first direction or a second direction, between a null position to a control position, the user interface further configured (i) upon receipt of an input force having a vector component in the first direction that exceeds a first null breakout force, to move from the null position to a first control position, (ii) upon receipt of an input force having a vector component in the first direction that exceeds a first soft stop force, to move beyond the first control position, (iii) upon receipt of an input force having a vector component in the second direction that exceeds a second null breakout force, to move from the null position to a third control position in the second direction, and (iv) upon receipt of an input force having a vector component in the second direction that exceeds a second soft stop force, to move beyond the third control position in the second direction; and a passive force feedback mechanism coupled to the user interface and configured to supply (i) the first and second null breakout force to the user interface when the user interface is in the null position, (ii) the first soft stop force to the user interface when the user interface is in the first control position, and (iii) the second soft stop force to the user interface when the user interface is in the third control position, wherein the passive force feedback mechanism comprises:

a first spring configured to supply the first null break out force to the user interface when the user interface is in the null position, a second spring configured to supply the first soft stop force to the user interface when the user interface is in the first control position, a third spring configured to supply the second null break out force to the user interface when the user interface is in the null position, and a fourth spring configured to supply the second soft stop force to the user interface when the user interface is in the third control position.

16. The assembly of claim 15, wherein:

the first soft stop force has a magnitude greater than the first null breakout force and is not supplied to the user interface unless the user interface is in the first control position, and the second soft stop force has a magnitude greater than the second null breakout force and is not supplied to the user interface unless the user interface is in the third control position.

17. The assembly of claim 16, wherein:

the first spring exhibits the first spring rate and is compressed at least when the user interface is between the null position and the first control position;

the second spring exhibits the second spring rate and is compressed at least when the user interface is between the first control position and the second control position;

the third spring exhibits the third spring rate and is compressed at least when the user interface is between the null position and the third control position; and the fourth spring exhibits the fourth spring rate and is compressed at least when the user interface is between the third control position and the fourth control position.

18. The assembly of claim 15, wherein:

the passive force feedback mechanism is further configured, upon movement of the user interface from the null position, to supply a feedback force to the user interface that urges the user interface toward the null position; and the feedback force is proportional to:

(i) a first spring rate when the control position of user interface is between the null position and the first control position, (ii) a second spring rate when the control position of the user interface is between the first control position and a second control position, (iii) a third spring rate when the control position of user interface is between the null position and the third control position, and (iv) a fourth spring rate when the control position of the user interface is between the third control position and a fourth control position.

19. A human-machine interface assembly, comprising:

a user interface configured, upon receipt of an input force that exceeds a null breakout force, to move from a null position to a first control position and, upon receipt of an input force that exceeds a soft stop force, to move beyond the first control position; and a passive force feedback mechanism coupled to the user interface and configured to supply (i) the null breakout force to the user interface when the user interface is in the null position and (ii) the soft stop force to the user interface when the user interface is in the first control position, the soft stop force exceeding the null breakout force and not supplied to the user interface unless the user interface is in the first control position, wherein the passive force feedback mechanism comprises:

a first spring configured to supply the null break out force to the user interface when the user interface is in the null position, a second spring configured to supply the soft stop force to the user interface when the user interface is in the first control position, a connection rod coupled to the user interface and configured to translate in response to movement of the user interface;

a first spring interface coupled to the connection rod and engaging the first spring, the first spring interface configured to translate with the connection rod, to thereby compress the first spring at least when the user interface is not in the null position, the first spring interface independently movable relative to the connection rod, whereby movement of the first spring interface relative to the connection rod adjusts the null breakout force, and a second spring interface engaging the second spring and configured to translate with the connection rod when the user interface is between the first control position and the second control position.

* * * * *